United States Patent [19]

Kishi

[11] 4,375,248

[45] Mar. 1, 1983

[54] LIFTING APPARATUS

[76] Inventor: Mitsuhiro Kishi, 1320 Mizuhonocho, Ashikaga-shi, Tochigi-Pref., 326-03, Japan

[21] Appl. No.: 221,952

[22] Filed: Dec. 31, 1980

[30] Foreign Application Priority Data

Jan. 17, 1980 [JP] Japan ..... 55-3924

[51] Int. Cl.[3] ..... B66B 11/04

[52] U.S. Cl. ..... 187/18; 182/141

[58] Field of Search ..... 187/8.71, 8.72, 18, 187/9 R; 254/122, 10 R, 10 C, 264, 265; 182/63, 69, 157, 158, 141; 92/137, 33, 31, 165 R

[56] References Cited

U.S. PATENT DOCUMENTS

| | | | |
|---|---|---|---|
| 2,156,204 | 4/1939 | Stolze | 187/9 |
| 3,299,983 | 1/1967 | Hubbard | 182/63 |
| 4,088,203 | 5/1978 | Smith, Jr. | 187/18 |
| 4,175,644 | 12/1979 | Sikli | 187/18 |

*Primary Examiner*—Joseph J. Rolla
*Assistant Examiner*—Kenneth Noland
*Attorney, Agent, or Firm*—Martin A. Farber

[57] ABSTRACT

A lifting apparatus comprising a basic support, a link-mechanism of the pantograph type extensively supported on the support, a platform provided on the link-mechanism, and driving devices actuated by hydraulic pressure to stretch the link-mechanism upwards. Each of the driving devices is comprised of a hydraulic cylinder, guiding members provided on opposite ends of the hydraulic cylinder, and a flexible connecting member. Both ends of the connecting member are connected respectively to upper and lower link levers of the link-mechanism, with the connecting member being in contact with the guiding member. Thus, the extension movement of the cylinder is transmitted to the link levers by the connecting member to stretch the link-mechanism of the pantograph type.

7 Claims, 8 Drawing Figures

LIFTING APPARATUS

BACKGROUND OF THE INVENTION

The present invention relates to a lifting apparatus with a platform which can be raised and lowered.

Conventionally, lifting apparatus hydraulically driven to elevate a platform with workers and materials mounted thereon have been used for working in an elevated position, such as for painting, working in high places during building, installing phone lines or a signboard. A typical conventional lifting apparatus is comprised of a platform supported on a link-mechanism of the pantograph type which is expanded and retracted by a hydraulic cylinder to raise and lower the platform. In this case, one end of the hydraulic cylinder is connected to a support disposed below the cylinder, the other end being connected to an intermediate portion of a link lever of the link-mechanism, so that the hydraulic cylinder is actuated in an inclined position. However, in such a construction, the force of cylinder is not fully used for expanding the link-mechanism of pantograph type, that is, the apparatus is operated at an extremely low efficiency.

In order to obtain a high efficient force from the hydraulic cylinder, the hydraulic cylinder should be disposed so that the direction of the expansion coincides with the direction of the raising and the lowering of the link-mechanism of the pantograph type. To accomplish this, an improved lifting apparatus has a construction wherein the expansion of a hydraulic cylinder is directly transmitted to the link lever, by the connection of both ends of hydraulic cylinder with the link levers by any suitable means, such as arms. However, in this lifting apparatus, the connection of hydraulic cylinder with the link lever becomes mechanically complicated, and further since a multistage hydraulic cylinder must be provided in order to elevate the platform on the link-mechanism of the pantograph type to a high position the resulting apparatus is quite expensive.

The object of the present invention is to overcome such problems and to provide a lifting apparatus with driving means comprising a hydraulic cylinder and a flexible connecting member such as chain, wire, so that a simple construction of a lifting apparatus furnishes a greater expansion of the link-mechanism for the total cylinder stroke and the retracted length of the cylinder.

With the above and other objects and advantages in view, the present invention will become more clearly understood in connection with the detailed description of preferred embodiments, when considered with the accompanying drawings, of which:

DETAILED DESCRIPTION OF PREFERRED EMBODIMENTS

Figure 1:
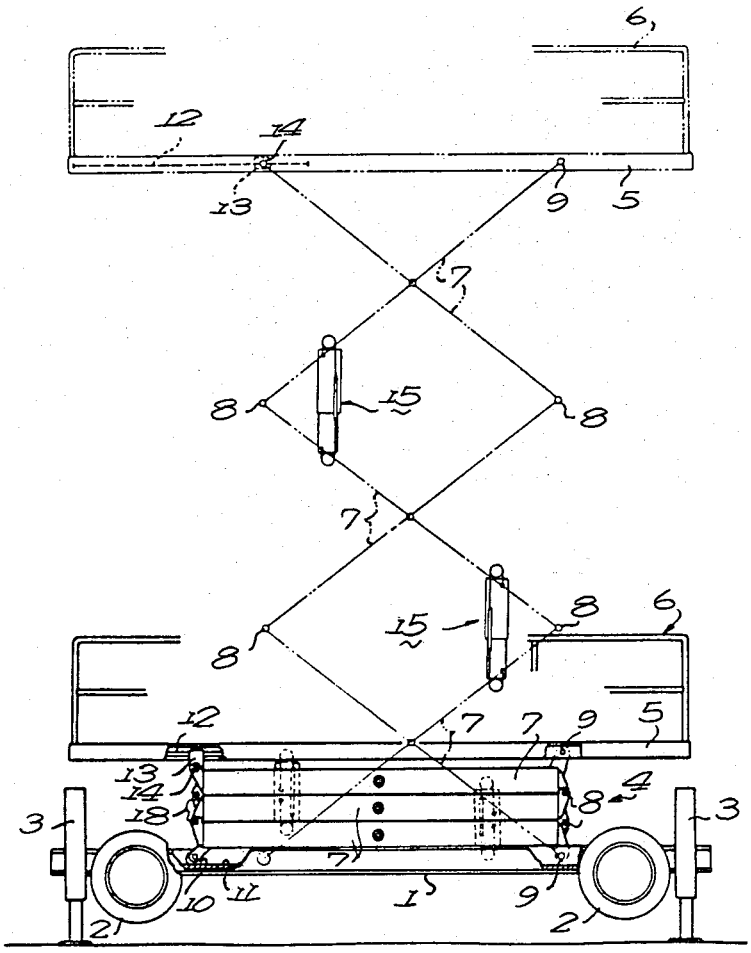
FIG. 1 is a side view showing a lifting apparatus incorporating one embodiment of the present invention when used on a trailer.

In the drawings, numeral 1 designates a vehicle body as a support (in this embodiment the vehicle is shown as a trailer), numeral 2 are wheels supported at four corners of the vehicle body 1, numeral 3 are adjustable fixing legs for supporting the vehicle body 1 on the ground. Disposed on the vehicle body 1 is a link-mechanism 4 of pantograph type, the upper end of which is provided with a platform 5 for workers. A set of handrails 6 is installed circumferentially on the platform 5.

The link-mechanism 4 is of the pantograph type and comprises plural pairs of link units which are disposed in parallel relationship on opposite sides of the vehicle body 1. Pairs of link units are arranged one on the other. One link unit comprises a pair of link levers 7 rotatably connected to each other at their mid-portions to form an X-shape. Each end of the link-lever 7 is rotatably connected to an end of an adjacent upper or lower link lever 7 by a connecting rod 8. The embodiment of FIGS. 1 and 2 thus shows a link-mechanism with three pairs of link units. Further, a pair of link units disposed parallel to each other are connected by the connecting rod 8.

One lower end of the X-link of the lowermost link unit, that is, a pair of lower ends of the pair of link units are connected to the vehicle body 1 on one side, and the other pair of lower ends of the pair of link units are provided with rollers 10 which are movable along a pair of rails 11 provided on the vehicle body 1.

One upper end of the X-link of the uppermost link unit, that is, a pair of upper ends of the pair of link units are connected to the platform 5 at one side, and the other pair of upper ends of the pair of link units are provided with sliding members 13 secured by pins 14 which are slidable along a sliding axis 12 provided on the undersurface of the platform 5. Two driving means 15 are disposed between the link units.

Figure 3:
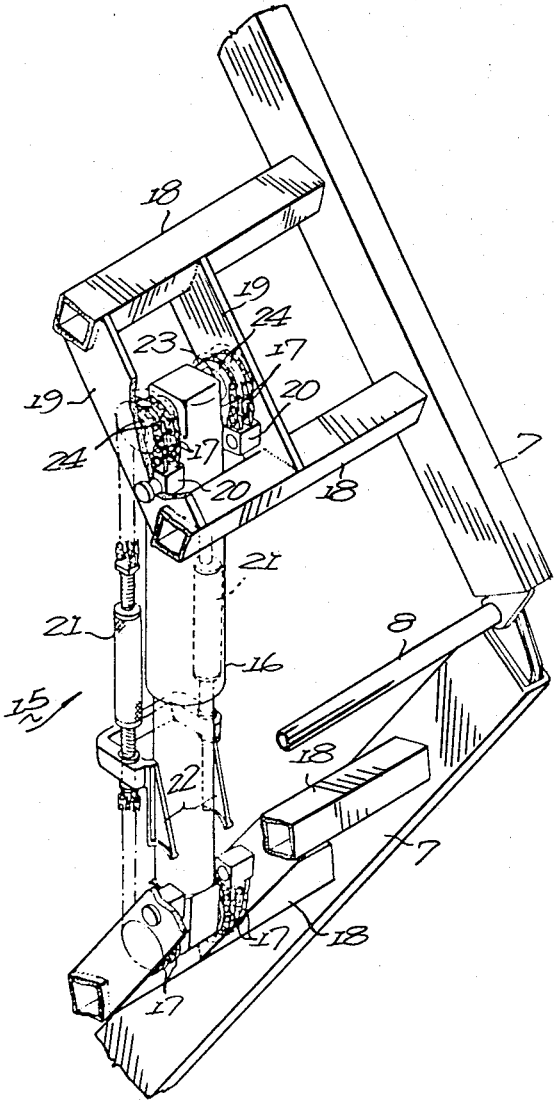
FIG. 3 is a fragmentary perspective view showing a driving means of the lifting apparatus.
Figure 4:
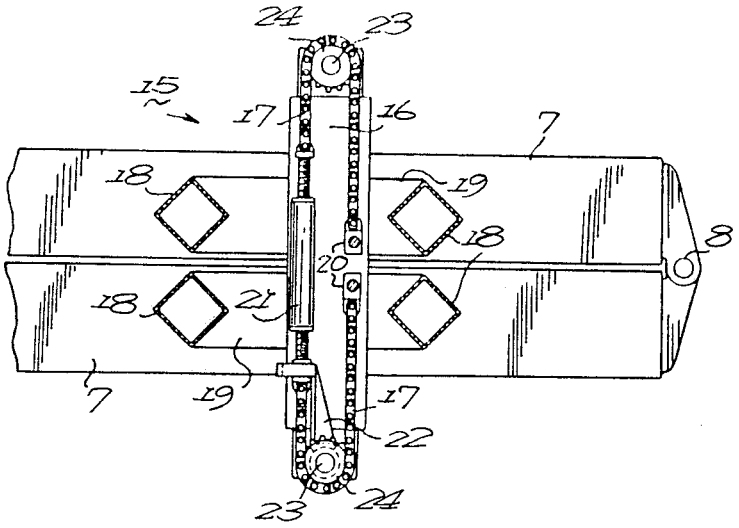
FIG. 4 is a side view showing the driving means, when link levers of the link-mechanism are folded.
Figure 5:
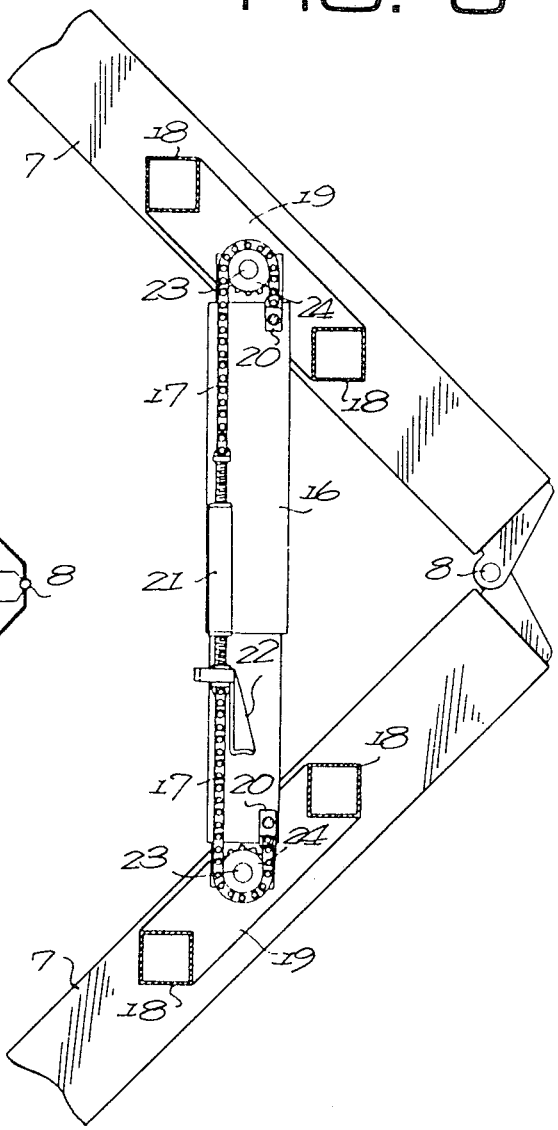
FIG. 5 is a side view showing the driving means, when the link levers of the link-mechanism are unfolded.

Each driving means 15 is comprised of a hydraulic cylinder 16 and chains 17 (shown in FIGS. 3–5). As shown in FIG. 3, between a pair of link levers, a pair of supporting rods 18 are provided to hold therebetween a pair of bridge members 19 provided with chain hooks 20. Between two chain hooks 20 of adjacent link levers, two pairs of chain 17 are arranged in C-shape. In the middle of each chain 17, a turnbuckle 21 is provided to adjust the interval and is controlled by a stop member 22.

At opposite ends of the hydraulic cylinder 16 are a pair of rotary shafts 23, each portion of which has a pair of sprocket wheels 24. The hydraulic cylinder 16 is in vertical position. Each sprocket wheel 24 engages with a respective chain 17.

A hydraulic pressure means 25 communicating with each cylinder 16 through hoses 26 is fixed on the vehicle body 1 for supplying the hydraulic fluid.

The actuation of present embodiment is explained hereinbelow.

Figure 2:
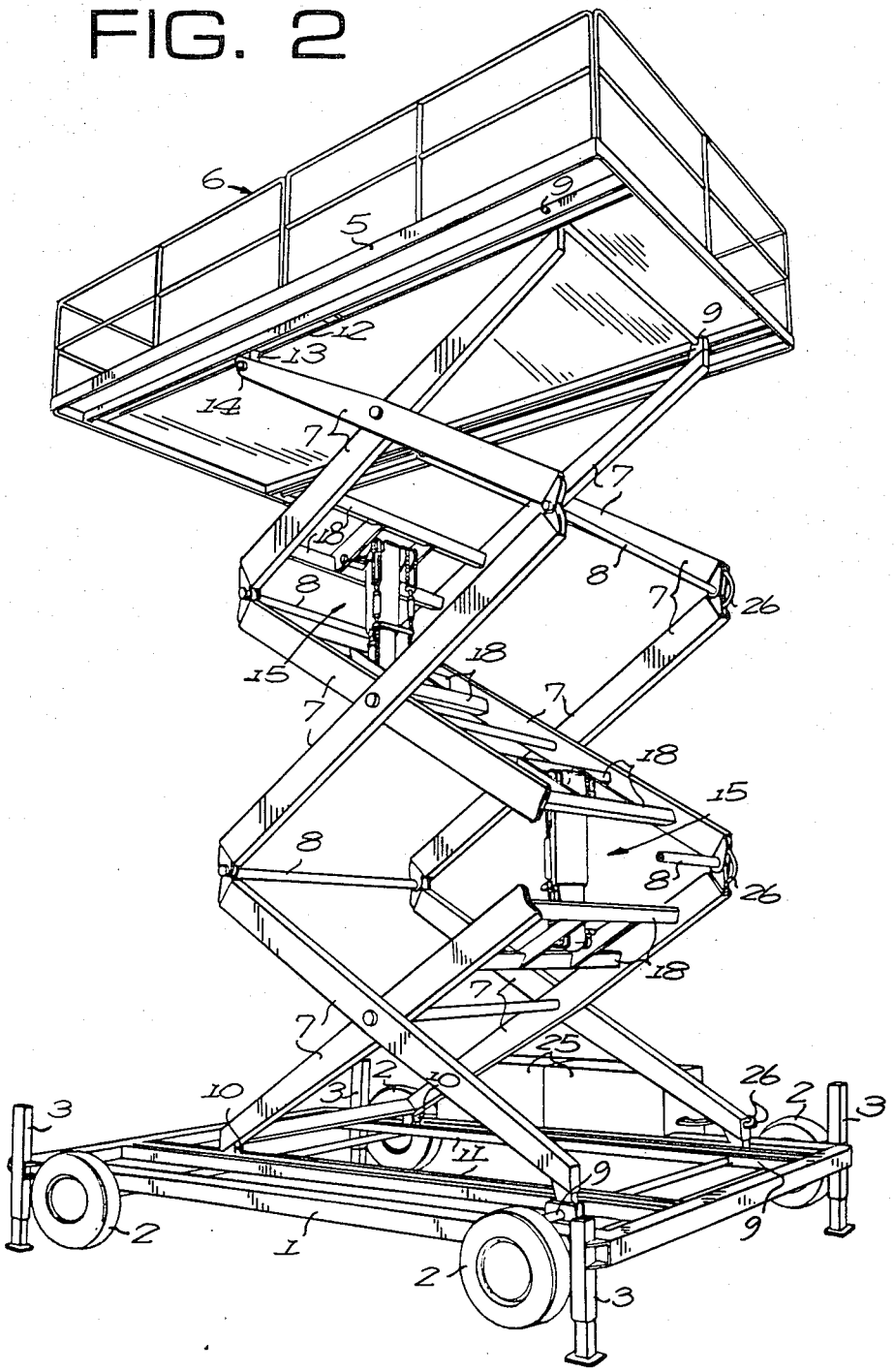
FIG. 2 is a perspective view of the lifting apparatus of FIG. 1, with the link-mechanism expanded.

The solid line portion of FIG. 1 shows the lowest position of the platform 5, the link mechanism 4 of pantograph type being folded. FIG. 4 shows the most retracted position of the driving means 15.

Figure 6:
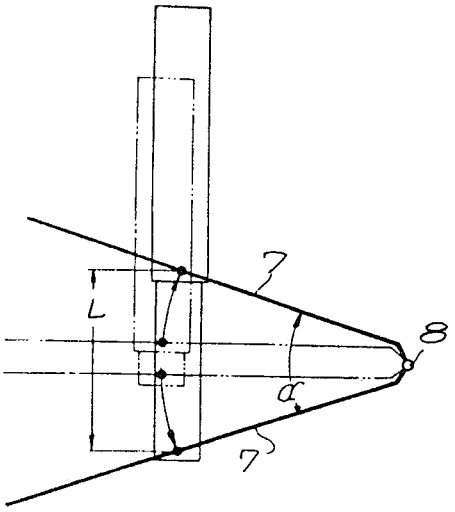
FIGS. 6, 7 are diagrammatical views illustrating the degree of angle of unfolded link levers.
Figure 7:
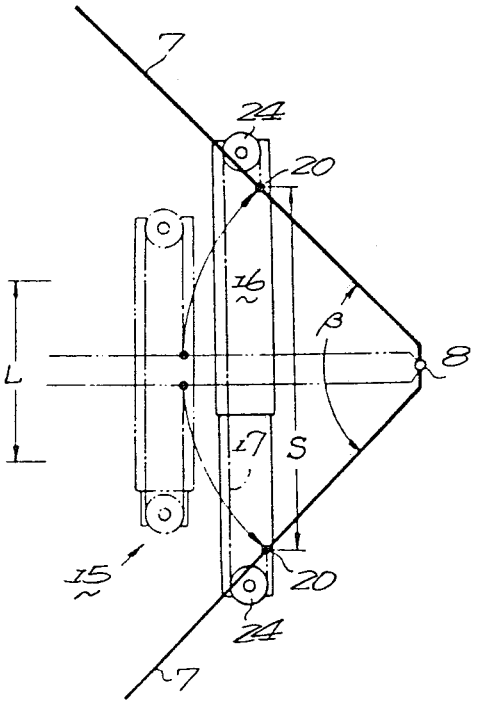

When the platform is to be elevated, the hydraulic pressure means 25 is actuated to supply each cylinder 16 with hydraulic fluid through the hoses 26. Thus, each cylinder 16 extends, to increase the distance between the shafts 23, and the chains 17 are pulled in opposite directions by opposite sprocket wheels 23. Because the both ends of each chain 23 are fixed to the chain hooks 20, the extending force by the cylinder 16 is transmitted to the chain 17 through the sprocket wheels 24, increasing the distance between the hooks 20, which results in a diverging movement of the link levers 7 about the connecting rod 8. Thus, the link mechanism 4 of the pantograph type stretches upward and raises the platform 5. In such diverging movement of the link levers 7, compared with the stroke of the piston rod of the hydraulic cylinder 16, the distance between the hooks 20 is about twice as large as the displacement of the cylinder 16. This is due to the extension force of the hydraulic cylinder 16 being transmitted to the link levers 7 by chains. The movement distance is shown in FIGS. 6, 7. FIG. 6 shows the opening angle of the link levers 7 when the levers are connected to a conventional hydraulic cylinder 16. FIG. 7 shows the opening angle of the link levers 7 used together with the cylinder according to the present invention. In both figures, either of the cylinders extends for the same distance L. However, in FIG. 6, the link levers open only a distance L making the angle $\alpha$. On the other hand, the distance between hooks 20 in FIG. 7 is longer than the distance L of the cylinder, making a larger opening angle $\beta$. Thus, the relatively short extension of the hydraulic cylinder 16 extends the link mechanism 4 to a higher level than the conventional cylinder.

When the link mechanism 4 of the pantograph type is to be closed to lower the platform 5, the hydraulic cylinder is retracted, to converge or fold the link levers 7. When the cylinder 16 is fully retracted, the stop member 22 engages with the periphery of the sprocket wheels 24 to limit the rotation of the sprocket wheels 24 and to prevent disengagement of the sprocket wheels 24 from the chain 26 so that the hydraulic cylinder does not fall away from the chain. Thus, the hydraulic cylinder 16 is held upright and ready for the next lift movement.

Figure 8:
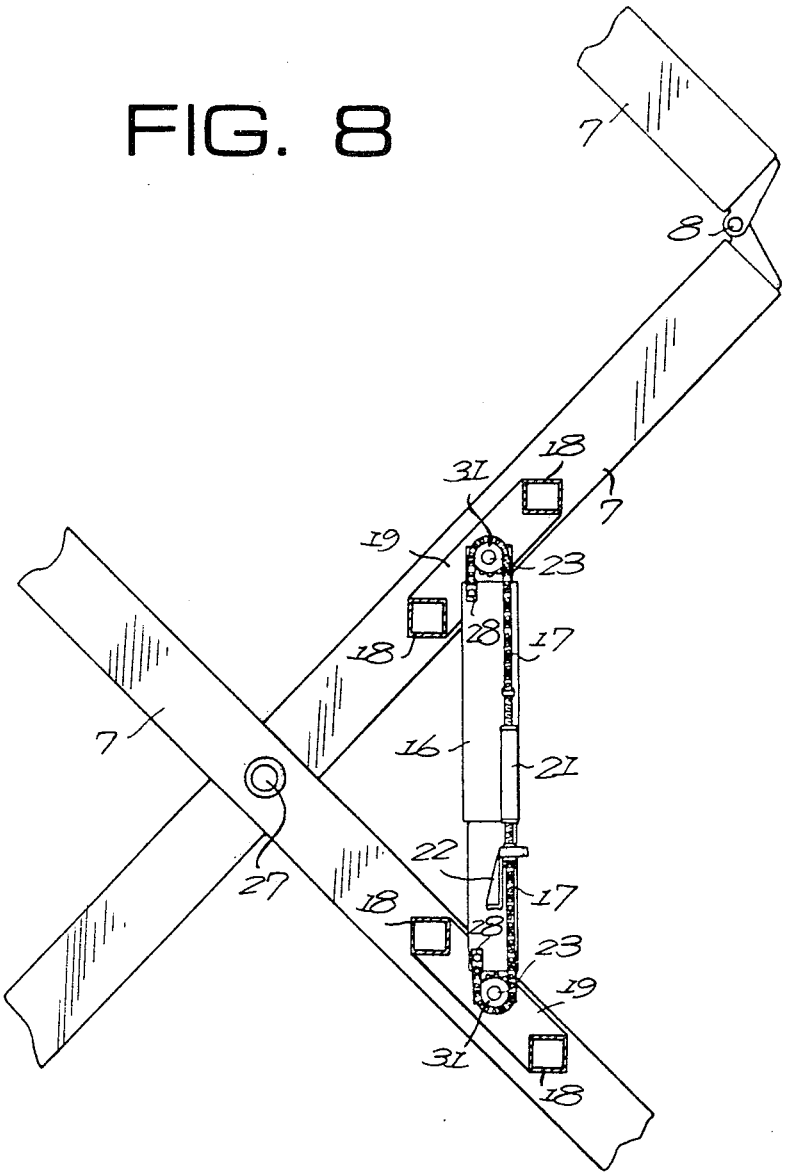
FIG. 8 is a diagrammatical view illustrating another embodiment of the lifting apparatus according to the present invention.

FIG. 8 shows another embodiment of this invention, wherein chain hooks 28 are fixed at a same distance from the mid-portion 27 of the X-shaped links 7. Each end of a chain 29 is connected to a respective hook 28, and, the inside of the chain 29 is engaged with sprocket wheels 31 provided at both ends of hydraulic cylinder 39. In this construction, the same operation of the link-mechanism for the previously described embodiment is carried out.

Although above described embodiments employ the transmission of movement by the chain mechanism, another transmission of movement by wire and pulleys can be employed in such a manner that the actuating force of the hydraulic cylinder is transmitted to link levers through the pulleys and wire.

Accordingly, the present invention provides a simple construction for a lifting apparatus, whereby multistage cylinders can be omitted and the cost of manufacturing of the apparatus may be lowered.

What is claimed is:

1. A lifting apparatus comprising a support, a work platform, and a pantographic lifting mechanism operatively coupled between said support and said work platform for elevating said work platform away from said support, said pantographic lifting mechanism including a plurality of pivotally connected X-link units, each of said X-link units having a pair of transversely spaced sets of two link levers pivotally connected at adjacent mid-portions of the link levers as a scissors linkage, the pivotal connection of said X-link units being at adjacent end portions of said link levers and actuating means operatively connected between adjacent pivotally connected ones of said link levers and actuatable for stretching said pantographic lifting mechanism, said actuating means including a floating hydraulic cylinder free from affixation to said pivotally coupled X-link units, a pair of guiding members rotatably mounted on each opposite end of said floating hydraulic cylinder, and a respective flexible connecting member having opposite ends fixed respectively to said adjacent pivotally coupled link levers and trained around said guiding members, whereby when said hydraulic cylinder is extended, said guiding members will be displaced away from each other to cause said opposite ends of said flexible connecting member to move away from each other for thereby forcing said adjacent pivotally coupled link levers to diverge away from each other.

2. The lifting apparatus according to claim 1, wherein said hydraulic cylinder has an operating position determined by engagement of said guiding members with said respective flexible connecting members, and said hydraulic cylinder is held in said operating position by engagement of said guiding members with said respective flexible connecting members.

3. The lifting apparatus according to claim 1, wherein each of said guiding members comprises a sprocket, and said flexible connecting member comprises a chain in meshing engagement with said sprocket, said chain including an intermediate turnbuckle for adjusting the length of said chain.

4. The lifting apparatus according to claim 3, wherein said chain has a stop member which is engageable with one of the sprockets when said floating hydraulic cylinder is fully retracted, to prevent said one sprocket from disengaging from said chain and thereby retain said floating hydraulic cylinder from falling away from said chain.

5. The lifting apparatus according to claim 1, wherein each of said X-link units further includes a pair of spaced transverse connecting rods extending between and connected to the transversely spaced link levers thereof, a respective bridge member extending between and joined to respective pairs of said connecting rods, and a chain hook mounted on each said bridge member, each of said opposite ends of said flexible connecting member being coupled to respective said chain hooks.

6. The lifting apparatus according to claim 1, wherein said adjacent pivotable ones of said link levers are included in adjacent ones of said X-link units.

7. The lifting apparatus according to claim 1, wherein said adjacent pivotable ones of said link levers are included in one of said X-link units.

* * * * *